US006784853B2

(12) United States Patent
Ikramov et al.

(10) Patent No.: US 6,784,853 B2
(45) Date of Patent: Aug. 31, 2004

(54) ANTENNA

(75) Inventors: Gairat Saidkhakimovich Ikramov, Moscow (RU); Aleksandr Vladimirovich Krishtopov, Moscow (RU)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 10/333,665

(22) PCT Filed: Apr. 23, 2001

(86) PCT No.: PCT/RU01/00165

§ 371 (c)(1),
(2), (4) Date: Jun. 23, 2003

(87) PCT Pub. No.: WO02/09230

PCT Pub. Date: Jan. 31, 2002

(65) Prior Publication Data

US 2004/0032376 A1 Feb. 19, 2004

(30) Foreign Application Priority Data

Jul. 20, 2000 (RU) ..... 2000119213

(51) Int. Cl.[7] ..... H01Q 1/36
(52) U.S. Cl. ..... 343/895; 343/700 MS
(58) Field of Search ..... 343/895, 700 MS; H01Q 1/36

(56) References Cited

U.S. PATENT DOCUMENTS 3,820,117 A * 6/1974 Hall et al. ..... 343/802
4,387,379 A * 6/1983 Hardie ..... 343/895
5,257,032 A 10/1993 Diamond et al.
6,191,756 B1 * 2/2001 Newham ..... 343/895

OTHER PUBLICATIONS

Benenson, L.S., "Super–Broadband Antennas", Mir Publishers, Moscow, 1964, pp. 151–154.
Fradin A.Z., "Antenna Feeder Devices", Sviaz Publishers, Moscow 1977.

* cited by examiner

*Primary Examiner*—Hoanganh Le
(74) *Attorney, Agent, or Firm*—Dilworth & Barrese, LLP

(57) ABSTRACT

The present invention relates to radio engineering and is applicable to antenna feeder devices, mainly to compact antennas with enhanced broadbanding. An antenna comprises a spiral antenna made by conductors arranged in a single plane and formed into a bifilar helix. Two antenna elements are disposed in the same plane and coupled, opposite to each other, to the conductors at outer turns of the bifilar helix. The bifilar helix is a rectangular spiral made by line segments with right angles of the turns. Each of the antenna elements forms an isosceles trapezoid and is coupled to a termination point of a conductor at a vertex of the smaller base of the isosceles trapezoid. The bases of the isosceles trapezoids are parallel to the line segments of the bifilar helix.

14 Claims, 3 Drawing Sheets

ANTENNA

The present invention relates to radio engineering and is applicable to antenna feeder devices, mainly to compact super-broadband antennas.

A conventional spiral antenna is made by conductors arranged in a single plane and formed into a bifilar rectangular spiral with turns directed opposite to each other (1).

The spiral antenna exhibits a relatively enhanced broadbanding as compared to the other types of antennas, such as dipole antennas, folded antennas, Y-antennas, rhombic antennas, etc.

However, to further enhance the broadbanding, the bifilar helix must be quite large, especially in cases when it is required to provide operation in the low-frequency range.

Another conventional antenna comprises antenna elements arranged in a single plane and coupled opposite to each other (2).

In this prior art, the antenna elements are plates in the shape of isosceles triangles with oppositely directed vertices, the opposite sides of the triangles being parallel to each other. The advantage of this antenna is that it is constructed on the self-complementarity principle according to which the shape and size of the metallic portion correspond and are equal to those of the slot portion complementing the metallic portion in the plane. Such infinite structure exhibits a purely active, frequency-independent input resistance, which improves its matching within a broad range of frequencies.

However, this antenna suffers a reduced broadbanding by input resistance due to finiteness of its geometrical dimensions.

Most closely approaching the present invention is an antenna comprising a spiral antenna made by conductors arranged in a single plane and formed into a bifilar helix, turns of the helix being directed opposite to each other, two antenna elements disposed in the same plane and oppositely coupled to the conductors at outer turns of both spiral paths of the bifilar helix, respectively (3).

In this system, the antenna elements form a half-wave dipole (or monopole) antenna with arms made by two pins. The above antenna system overcomes, to a certain extent, the problems of conventional antennas. The spiral antenna operates in the high-frequency range, while the boundary of the low-frequency range depends on the antenna's diameter and is of the order of $0.5\lambda$, where $\lambda$ is the working wavelength. Beginning from these frequencies, the half-wave dipole antenna is brought into operation. The half-wave dipole antenna may be coupled to the spiral antenna either at outer or inner termination points.

The antenna system in accordance with the most pertinent prior art suffers the following deficiencies:

- it has considerable geometrical dimensions because the size of the spiral should be no less than $0.5\lambda$, and the size of the dipole antenna should be $0.5\lambda_{max}$;
- its broadbanding is insufficient because the half-wave dipole antenna is a narrow-band device, and the input resistance varies as a function of frequency at the connection points of the dipole arms, this significantly affecting the broadbanding of the system;
- the galvanic coupling of two antenna systems with different resistances impairs the quality of matching.

The object of the present invention is to improve performance and extend the stock of employed technical means.

The present invention provides an antenna that exhibits an enhanced broadbanding and improved standing wave ratio (SWR), is simple in construction while maintaining a small size.

The object of the present invention can be attained in a conventional antenna comprising a spiral antenna made by conductors disposed in a single plane and formed into a bifilar helix, turns of the bifilar helix being directed opposite to each other, two antenna elements arranged in the same plane and coupled, oppositely to each other, to termination points of the conductors at outer turns of the bifilar helix, respectively, wherein in accordance with the present invention, the bifilar helix is a rectangular spiral made by line segments with right angles of the turns, each of the antenna elements forming an isosceles trapezoid and coupled to a termination point of a conductor at a vertex of the smaller base of the isosceles trapezoid, the bases of the isosceles trapezoids being parallel to the line segments of the bifilar helix.

In further embodiments of the antenna in accordance of the invention it may be provided that

- the line segments of the bifilar helix are straight;
- the conductors are formed into a square-shaped bifilar spiral;
- distances between opposite vertices of the large bases of the isosceles trapezoids of the antenna elements are equal to each other and to a distance between all adjacent vertices of the large bases;
- sizes of spacings between the conductors of the bifilar helix are equal to a thickness of the conductors;
- length L of the smaller base of the isosceles trapezoid is $L=l+2\delta$, where l is the length of the straight-line segment of the turn of the bifilar helix, directed to the base of the isosceles trapezoid, and $\delta$ is the size of the spacing between the turns of the bifilar helix;
- the antenna element is a solid plate;
- the antenna element is a zigzag thread having bending angles which correspond to the shape of an isosceles trapezoid, so as zigzag parts of the zigzag thread coincide with the lateral sides of the isosceles trapezoid, and the connecting zigzag parts of the zigzag thread are parallel to the bases of the isosceles trapezoid;
- sizes of the spacings between the conductors of the bifilar helix are equal to sizes of spacings between the parts of the zigzag thread which are parallel to the bases of the isosceles trapezoid;
- the zigzag thread of the antenna elements forms a meander along its longitudinal axis;
- the zigzag thread of the antenna elements forms, along its longitudinal axis, a constant pitch structure which is defined, within the constant pitches, by a pseudo-random sequence of digits 0 and 1 with the same average frequency of occurrence of the digits;
- each of the conductors forms a meander along its longitudinal axis;
- each of the conductors of the bifilar helix forms, along its longitudinal axis, a constant pitch structure which is defined, within the constant pitches, by a pseudo-random sequence of digits 0 and 1 with the same average frequency of occurrence of the digits;
- the conductors and the antenna elements have a high resistivity.

The above object of the present invention has been attained owing to forming the antenna into a bifilar rectangular spiral and using the antenna elements in the shape of an isosceles trapezoid. The antenna system (AS), in general, is constructed on the self-complementarity principle; it includes a bifilar rectangular Archimedes spiral; extensions of the bifilar helix are plates having a width linearly increasing with a distance from the center of the helix, or a conductive zigzag thread which fills the area of the plates. Broadbanding of the AS may be further enhanced by making all of the conductors meander-shaped and of a high-resistivity material.

Figure 4:
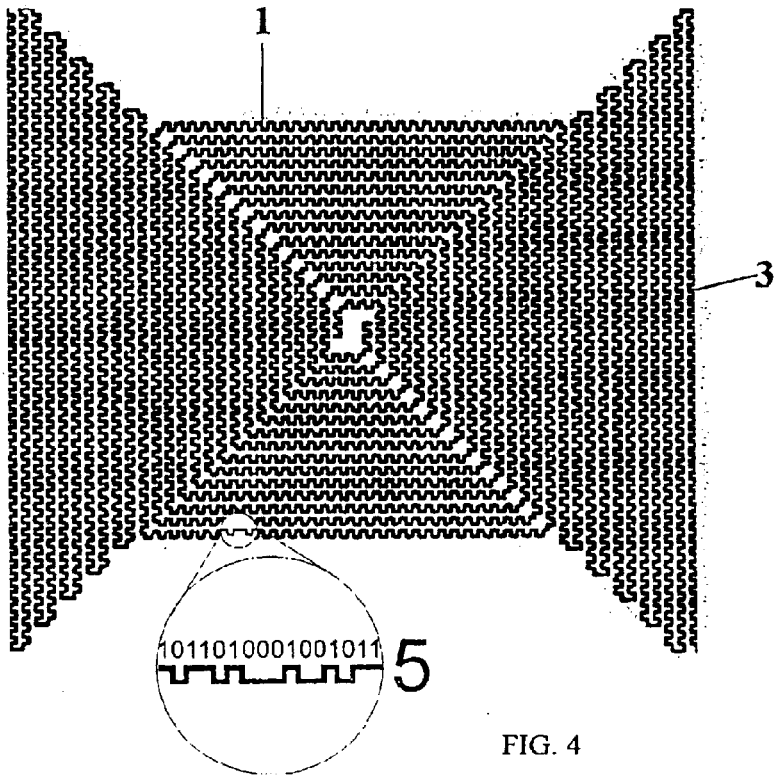
Figure 5:
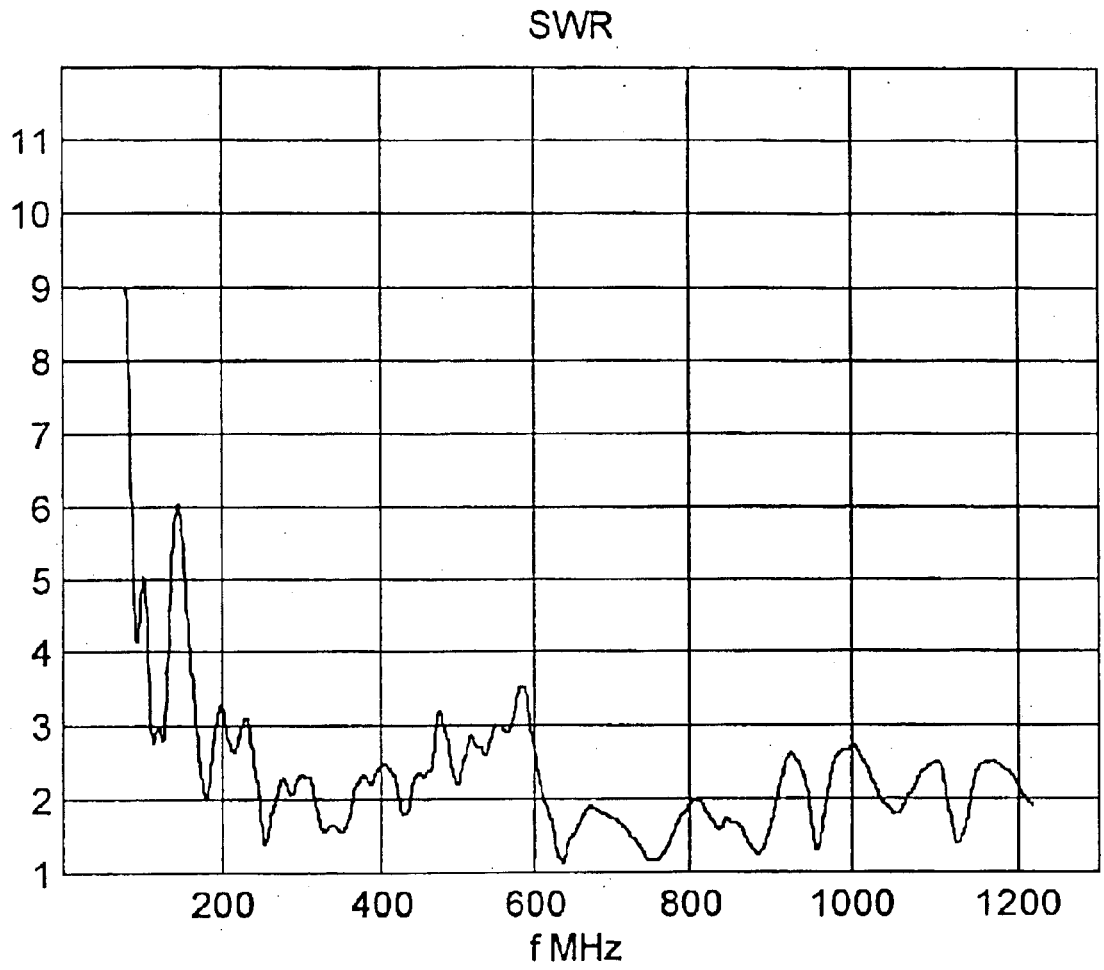

FIG. 4 shows an embodiment of an antenna in accordance with the present invention, in which all of the conductors and the zigzag threads of the antenna elements form a non-periodic constant pitch meander structure, with periods in the structure being defined by a pseudo-random sequence of digits 0 and 1 with the same average frequency of occurrence of the digits, FIG. 5 is a plot of the standing wave ratio (SWR) adjusted to the characteristic impedance of 75 Ohm.

Figure 1:
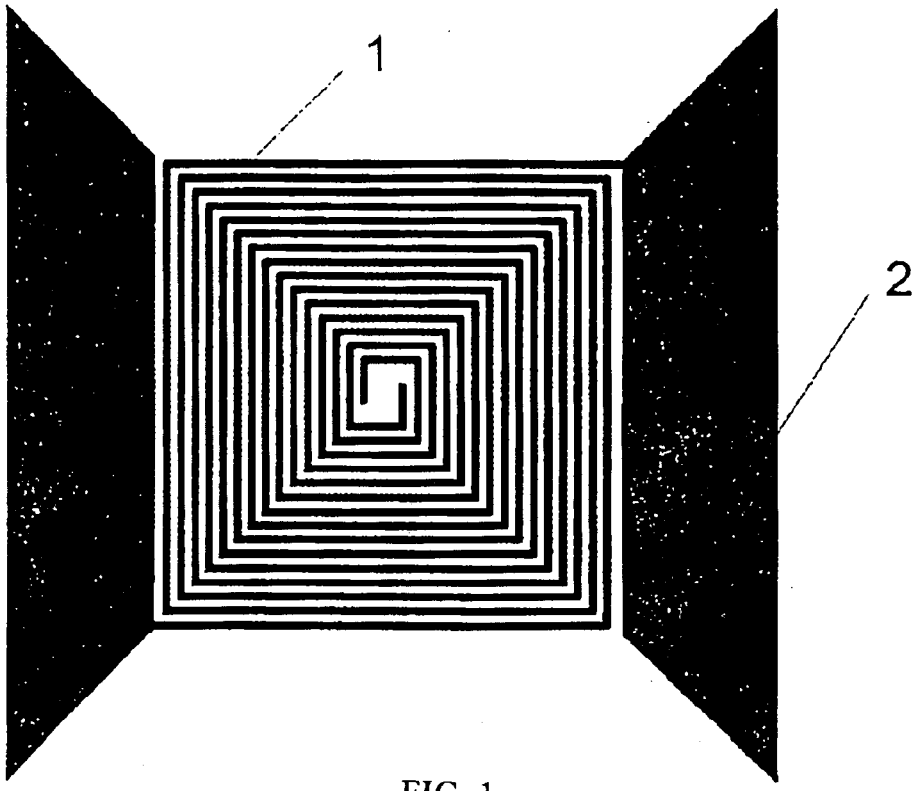
FIG. 1 shows an embodiment of an antenna in accordance with the present invention with antenna elements made by plates in the shape of isosceles trapezoids.

Referring now to FIG. 1, a compact super-broadband antenna comprises a spiral antenna 1 formed by conductors disposed in a single plane and formed into a bifilar helix. Turns of the bifilar spiral are directed opposite to each other. The conductors of the spiral antenna 1 form line segments with right angles of turns.

Two antenna elements 2 are arranged in the same plane with the bifilar helix. The antenna elements 2 are oppositely coupled to each of the conductors of both spiral paths at outer turns of the bifilar helix, respectively. Each of the antenna elements 2 forms an isosceles trapezoid and is coupled to a termination point of the conductor at a vertex of the smaller base of the isosceles trapezoid. The bases of the isosceles trapezoids are parallel to the line segments of the bifilar helix of the spiral antenna 1. In one embodiment, the line segments of the bifilar spiral may be straight. A simpler construction of a smaller size may be provided in a planar implementation, in which all individual components are arranged in a single plane. Such an embodiment may be easily constructed and fabricated using the microstrip technology. An enhanced broadbanding and improved standing wave ratio may be attained by making the AS integrated, in which all of the components are in a single plane and meet the self-complementarity principle.

To fully satisfy the self-complementarity criteria, the conductors of the spiral antenna 1 (FIG. 1) may be formed into a bifilar square helix with vertices of right angles of each turn being disposed at vertices of a square at the same distance along the diagonal and the sides of an imaginary square, taking into account the difference caused by an interval between the conductors, so as to arrange them in accordance with the Archimedes spiral.

In this embodiment, the distances between opposite vertices of the large bases of the isosceles trapezoids of the antenna elements 2 may be equal, as well as equal are the distances between all adjacent vertices of the large bases. In order to construct the entire antenna system (AS) on the self-complementarity principle, in this embodiment the vertices of the large bases of the isosceles trapezoids of the antenna elements 2 (FIG. 1) are at the points corresponding to vertices of the imaginary square.

In the embodiment, sizes of spacings between the conductors are equal to a thickness of the conductors forming the bifilar helix of the spiral antenna 1.

Length L of the smaller base of the isosceles trapezoids formed by the antenna elements 2 is $L=l+2\delta$, where l is the straight line segment of the bifilar helix turn, directed to the base of the isosceles trapezoid, $\delta$ is the size of the spacing between the turns of the bifilar helix.

In the embodiment, vertices of the isosceles trapezoids lie precisely on the diagonal of the imaginary square.

The antenna element 2 (FIG. 1) may be directly made from a conducting plate, this offering an enhanced broadbanding, improved standing wave ratio (SWR) and smaller size of the antenna system as compared to the most pertinent prior art system. The spiral antenna 1 is made by turns with right angles, and antenna elements 2 are integrated with the spiral antenna rather than to be separate elements disclosed e.g. in (2), but they should satisfy the self-complementarity principle in combination with the spiral antenna 1.

Figure 2:
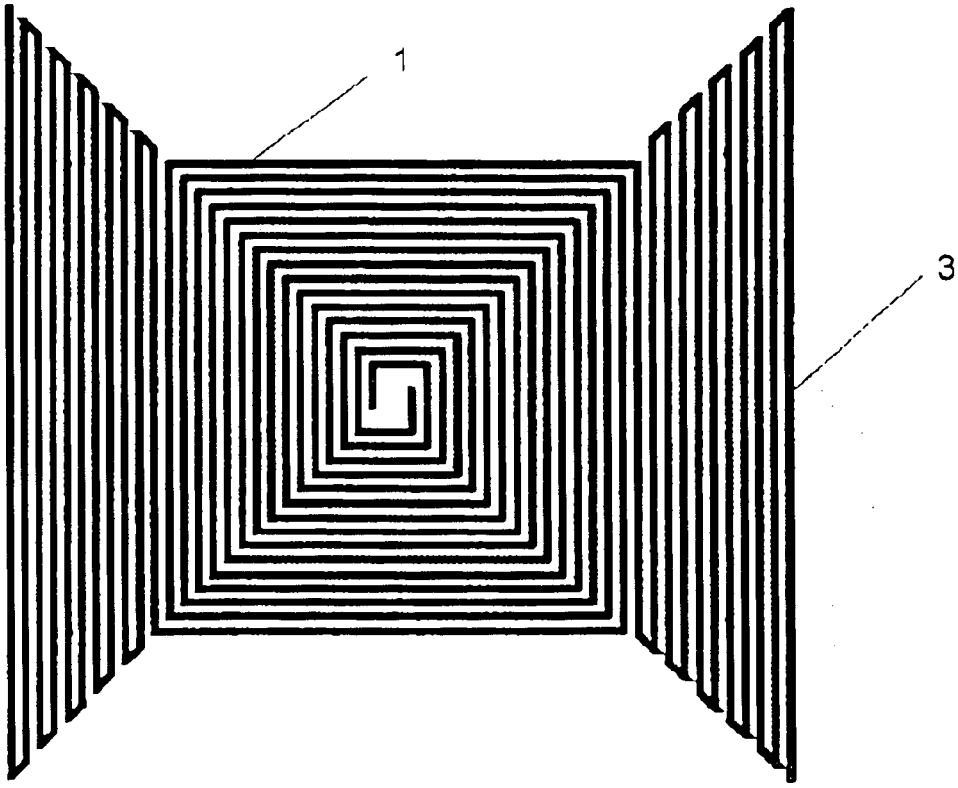
FIG. 2 shows an embodiment of an antenna in accordance with the present invention, formed by a bifilar rectangular Archimedes spiral continued by a zigzag thread having a width linearly increasing with a distance from the center of the spiral.

Broadbanding, however, may be further enhanced by making the antenna element 2 (FIG. 2) from a conducting zigzag thread 3. Bending angles of the zigzag thread 3 correspond to the shape of an isosceles trapezoid. Zigzag parts of the zigzag thread coincide with lateral sides of an imaginary isosceles trapezoid, while the connecting zigzag parts of the zigzag thread are parallel to the bases of the imaginary isosceles trapezoid. In this case, the zigzag thread 3 (FIG. 2) looks as if filling the entire area of the plates (FIG. 1).

To satisfy the self-complementarity principle, sizes of the spacings between the conductors of the bifilar helix (FIG. 2) are equal to sizes of the spacings between the zigzag thread parts which are parallel to the bases of the isosceles trapezoid.

Figure 3:
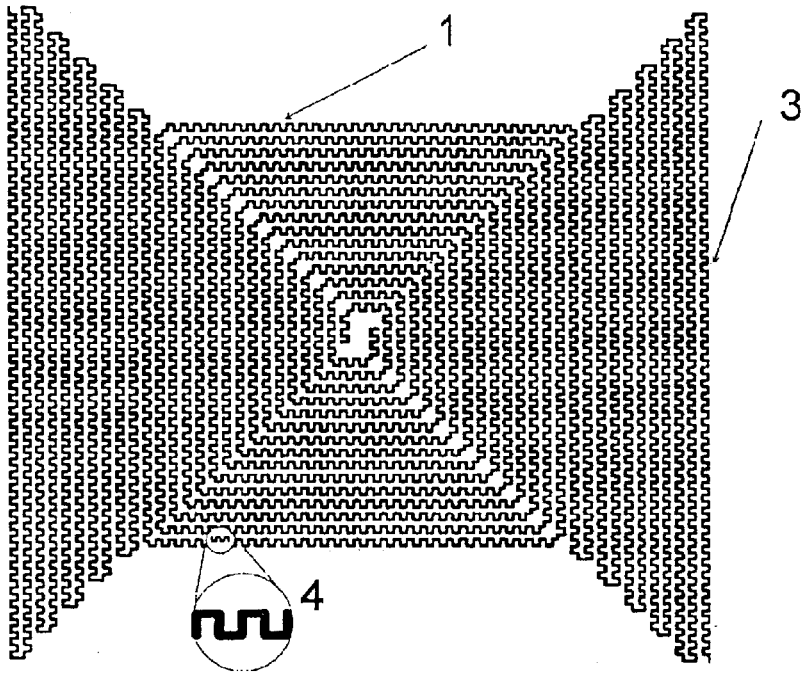
FIG. 3 shows an embodiment of an antenna in accordance with the present invention, in which all of the conductors and the zigzag threads of the antenna elements form meanders.

Broadbanding of the system as a whole may be further increased by making the zigzag thread 3 of the antenna elements 2, along its longitudinal axis, in the shape of meander (FIG. 3). For the same purpose, each of the conductors of the spiral antenna 1 is meander-shaped along its longitudinal axis. In FIG. 3, numeral 4 shows an enlarged view of the shape of the conductor of the spiral antenna 1.

To cancel local resonances which may lead to the increase in the travelling wave ratio (TWR), and to further enhance broadbanding of the system as a whole, it will be advantageous to make the zigzag thread 3 of the antenna elements 2, along its longitudinal axis, as a meander-shaped non-periodic constant pitch structure with periods between the constant pitches in the structure being defined by a pseudo-random sequence of digits 0 and 1 with the same average frequency of occurrence of the digits (FIG. 4). Likewise, each of the conductors of the spiral antenna 1 may form a meander-shaped non-periodic constant pitch with periods between the constant pitches in the structure being defined by a pseudo-random sequence of digits 0 and 1 with the same average frequency of occurrence of the digits. Numeral 5 in FIG. 4 shows the shape of the conductors of the spiral antenna 1 with subscriptions of a corresponding part of the pseudo-random sequence over a fragment of the non-periodic meander structure.

The conductors of the spiral antenna 1 and the antenna elements 2, be them plates or a zigzag thread (FIGS. 1–4), may have a high resistivity. By way of example, the antenna elements 2 may be plates with a sprayed resistive layer having a resistance smoothly increasing towards the large base of the isosceles trapezoid. The conductors of the spiral antenna 1 and the zigzag thread 3 may be made from a resistive wire with a resistance smoothly changing from the center of the antenna system (AS) towards its edges.

A compact super-broadband antenna (FIGS. 1–4) in accordance with the invention operates as follows.

In the low-frequency range, the spiral antenna 1 (square bifilar Archimedes spiral) acts as a two-conductor transmission line which gradually changes to a radiating structure, the antenna elements 2 in the shape of an isosceles trapezoid. The antenna elements 2 may be either conductive plates (FIG. 1) having a width linearly increasing with the distance from the center of the spiral, or a zigzag thread 3 (FIG. 2) filling the area of the isosceles trapezoids.

The embodiment (FIG. 3) with the conductors of the spiral antenna 1 and the zigzag thread 3 in the shape of meander (as shown by 4) provides the velocity of the progressive current wave equal to approximately 0.4–0.5 the velocity of the current wave along a smooth structure. For this reason, despite small geometrical dimensions of the antenna system, $\lambda_{max}/10$, where $\delta_{max}$ is the maximum wavelength, the system exhibits a great relative electric length.

In low and middle-frequency ranges, the antenna pattern is the same as that of a broadband dipole at SWR<4 (FIG. 5). In a higher frequency range, in which the dimensions of the square Archimedes spiral become equal to $\lambda/7$, where $\lambda$ is the working wavelength, the bifilar helix acts as the main radiating structure. In the high-frequency range, the bandwidth characteristics of the antenna system are restricted by the precision of fulfilling the excitation conditions and the changes in the antenna pattern. The standing wave ratio (SWR) changes within the frequency range from to 1.5 to 3 (FIG. 6).

The system in accordance with the present invention is based on the self-complementarity principle, i.e. the metallic portion and the slot portion have absolutely the same shape and dimensions, this ensuring the constant input resistance R≈100 Ohm within a broad finite bandwidth. The use of the square-shaped Archimedes spiral is dictated by $4/\pi$ times smaller geometric dimensions as compared to a circular spiral. The use of slow-wave structures and the absence of galvanic couplings between the components ensures the improvement in matching between the system having small geometric dimensions and the feed. The antenna may be excited by a conical line-balance converter representing a smooth transition between the coaxial line and the two-wire line.

The antenna in accordance with the present invention may be most successfully employed in radio engineering to construct antenna feeder devices with improved performance.

REFERENCES CITED

1. <<Super-Broadband Antennas>>, translated from English by Popov S. V. and Zhuravlev V. A., ed. L. S. Benenson, "Mir" Publishers, Moscow, 1964, pages 151–154.
2. Fradin A. Z. "Antenna Feeder Devices", "Sviaz" Publishers, Moscow, 1977.
3. U.S. Pat. No. 5,257,032, IPC I 01 Q 1/36, published on Oct. 10, 1993.

What is claimed is:

1. An antenna comprising:

a spiral antenna made by conductors disposed in a single plane and formed into a bifilar helix, turns of the bifilar helix being directed opposite to each other, two antenna elements disposed in the same plane and coupled, opposite to each other, to termination points of the conductors at outer turns of the bifilar helix, respectively, wherein said bifilar helix is a rectangular spiral made by line segments with right angles of the turns, each of the antenna elements forms an isosceles trapezoid and is coupled to a termination point of a conductor at a vertex of the smaller base of the isosceles trapezoid, the bases of the isosceles trapezoids being parallel to the line segments of the bifilar helix.

2. The antenna according to claim 1, wherein said line segments of the bifilar helix are straight.

3. The antenna according to claim 1, wherein said conductors are formed into a square-shaped bifilar spiral.

4. The antenna according to claim 3, wherein distances between opposite vertices of the large bases of the isosceles trapezoids formed by the antenna elements are equal to each other and to a distance between all adjacent vertices of the large bases.

5. The antenna according to claim 1, wherein sizes of spacings between the conductors of the bifilar helix are equal to a thickness of the conductors.

6. The antenna according to claim 5, wherein length L of the smaller base of the isosceles trapezoid is $L=l+2\delta$, where l is the length of a straight-line segment of the turn of the bifilar helix, directed to the base of the isosceles trapezoid, and $\delta$ is the size of the spacing between the turns of the bifilar helix.

7. The antenna according to claim 1, wherein said antenna element is a solid plate.

8. The antenna according to claim 1, wherein said antenna element is a zigzag thread having bending angles which correspond to the shape of an isosceles trapezoid, so as zigzag parts of the zigzag thread coincide with the lateral sides of the isosceles trapezoid, and the connecting zigzag parts of the zigzag thread are parallel to the bases of the isosceles trapezoid.

9. The antenna according to claim 8, wherein sizes of the spacings between the conductors of the bifilar helix are equal to sizes of spacings between the parts of the zigzag thread which are parallel to the bases of the isosceles trapezoid.

10. The antenna according to claim 8, wherein said zigzag thread of the antenna elements forms a meander along its longitudinal axis.

11. The antenna according to claim 9, wherein said zigzag thread of the antenna elements forms, along its longitudinal axis, a constant pitch structure which is defined, between the constant pitches, by a pseudo-random sequence of digits 0 and 1 with the same average frequency of occurrence of the digits.

12. The antenna according to claim 1, wherein each of said conductors forms a meander along its longitudinal axis.

13. The antenna according to claim 12, wherein each of said conductors of the bifilar helix forms, along its longitudinal axis, a constant pitch structure which is defined, between the constant pitches, by a pseudo-random sequence of digits 0 and 1 with the same average frequency of occurrence of the digits.

14. The antenna according to claim 1, wherein said conductors and said antenna elements have a high resistivity.

* * * * *